United States Patent [19]

Kanno et al.

[11] Patent Number: 4,509,732

[45] Date of Patent: Apr. 9, 1985

[54] DOCUMENT HANDLING APPARATUS FOR PRODUCING FOLDED AND BOUND STACKS OF DOCUMENTS

[75] Inventors: Tadaaki Kanno, Yokosuka; Takeshi Ukai, Yokohama; Yutaka Akahoshi, Funabashi; Katsuji Shibata, Kiyose, all of Japan

[73] Assignee: Ricoh Company, Ltd., Tokyo, Japan

[21] Appl. No.: 123,007

[22] Filed: Feb. 20, 1980

[30] Foreign Application Priority Data

Feb. 24, 1979 [JP] Japan ..... 54-21245

[51] Int. Cl.[3] ..... B41L 43/12

[52] U.S. Cl. ..... 270/37; 198/457; 198/787

[58] Field of Search ..... 270/37, 53, 68 A, 58; 271/274, 251, 185; 198/457; 355/133, 50; 227/37, 144

[56] References Cited

U.S. PATENT DOCUMENTS

| | | | |
|---|---|---|---|
| 2,058,877 | 10/1936 | Hitchcock | 270/68 A |
| 3,502,255 | 3/1970 | Herman | 270/53 |
| 3,554,531 | 1/1971 | Heigl | 270/53 |
| 3,669,537 | 6/1972 | Kabayashi | 270/53 |
| 3,703,626 | 11/1972 | Shanrock | 271/251 |
| 3,709,595 | 1/1973 | Turner | 270/53 |
| 3,743,161 | 7/1973 | Spencer | 227/144 |
| 4,146,216 | 3/1979 | Brown | 270/58 |
| 4,155,440 | 5/1979 | Bogdanski | 271/185 |

*Primary Examiner*—Clifford D. Crowder

*Attorney, Agent, or Firm*—Wyatt, Gerber Shoup, Scobey & Badie

[57] ABSTRACT

A document handling apparatus comprises a first conveyor means for conveying a document to a given location, a document stacking means for receiving documents conveyed by the first conveyor means and maintaining them at said location to form them into a stack, a stapling means for stapling the stack of documents, and a second conveyor means for conveying the stapled stack of documents out of said given location. The first or the second conveyor means comprises a conveyor roller or rollers, and an electromagnetic ball control device which brings a steel ball into abutment against or away from the conveyor rollers in response to an operation of an electromagnet.

13 Claims, 19 Drawing Figures

DOCUMENT HANDLING APPARATUS FOR PRODUCING FOLDED AND BOUND STACKS OF DOCUMENTS

BACKGROUND OF THE INVENTION

When documents such as copies or prints which are produced by a copying machine or a printing machine are fed into a document handling apparatus which is provided with a folding machine or a stapling machine, it is possible that the documents may be conveyed in a folding machine of the document handling apparatus in a direction which is different from the direction in which the documents are delivered from a copying machine. Hence, there is some document handling apparatus in which the documents delivered thereto are conveyed in a different direction in order to feed them into a folding machine.

A document conveying means which is used in a conventional document handling apparatus of this type includes inlet feed roller pairs and delivery roller pairs which deliver the documents in a different direction from the feed direction, each pair comprising a vertically spaced conveyor roller and a feed roller. An arrangement is made such that the respective feed rollers are movable toward or away from their associated conveyor rollers in each of the inlet roller pairs and delivery roller pairs at the point where the document changes direction, and the rotating drive to the conveyor rollers can be interrupted so that when a document is being fed in, the feed roller of the delivery roller pairs which is located at the point of the change of direction of the document can be moved away from the delivery roller while the rotating drive to the latter is interrupted. Conversely, when the document is being delivered, the feed roller, of the inlet roller pairs which is located at the point of directional change can be moved away from the associated conveyor rollers while interrupting the rotating drive to the latter rollers.

Conventional document conveyor means used in a document handling apparatus of this kind requires a mechanism including a combination of electromagnets and linkages which move the feed roller or rollers toward or away from their associated conveyor rollers, an electromagnetic clutch to interrupt the rotating drive to the conveyor rollers, or a complex control circuit for controlling these elements, resulting in an increased size of the arrangement and a poor reliability, durability and maintenance capability, and increased production costs.

SUMMARY OF THE INVENTION

It is an object of the invention to provide a document handling apparatus having document conveyor means of a simplified construction to reduce the size of the arrangement and to improve the reliability, durability and maintenance capability thereof to result in a reduced production cost while assuring a smooth document conveying operation.

It is another object of the invention to provide a document handling apparatus which enables a change in the direction in which a document is being conveyed in a simplified manner.

It is a further object of the invention to provide a document handling apparatus which enables the position or attitude of a document being conveyed to be easily changed.

In accordance with the invention, a document handling apparatus comprises a first conveyor means which detects the presence of a document prepared by a copying machine, a printing machine or the like and conveys it to a given location. A document stacker receives the documents and maintains them at the location to form them into a stack. A stapling device for stapling the stack of documents, and a second conveyor means which delivers the stapled stack of documents is also provided. The first or the second conveyor means comprises a conveyor roller or rollers and an electromagnetic ball control device which brings a steel ball into abutment against or away from the conveyor rollers in response to an operation of an electromagnet.

In accordance with the invention, the document conveyor means comprises the conveyor rollers and the electromagnetic ball control device alone. In addition to the simple arrangement achieved, the movement of documents can be easily controlled, thus assuring an improved reliability of operation, durability and maintenance capability. The steel balls are brought into abutment against a document placed on the conveyor rollers by point contact, and the steel balls are allowed to rotate in the same direction as the document is being conveyed, so that the change the direction in which the document is being conveyed and the control of the position of the document can be smoothly achieved.

DESCRIPTION OF PREFERRED EMBODIMENTS

Figure 1:
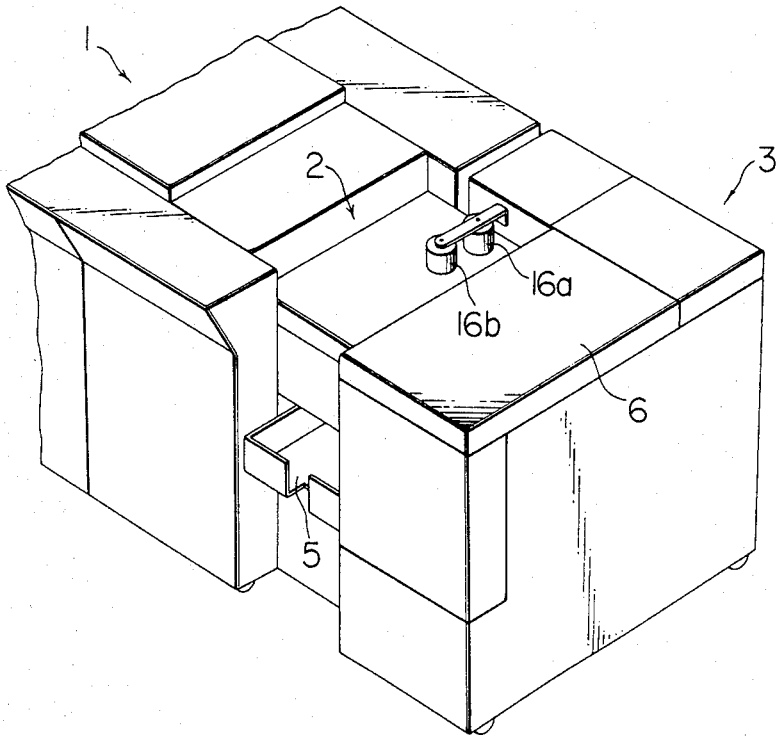
FIG. 1 is a perspective view of a copying machine in which an embodiment of the invention is incorporated.
Figure 2:
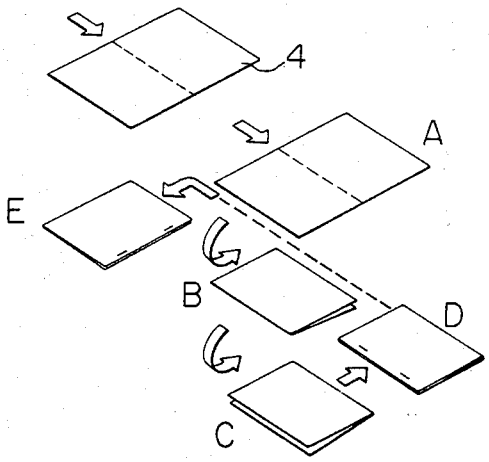
FIG. 2 is a schematic exploded view illustrating the movement of the document in the embodiment of the invention.

Referring to FIG. 1, there is shown a copying machine 1 in which one embodiment of the invention is incorporated. The machine 1 includes a document delivery end 2, to which is connected a sheet feed inlet of a document conveying apparatus 3 which is provided with a folding and a stapling device. As indicated in FIG. 2, in the document conveying apparatus 3, a document 4 which is fed from the copying machine 1 continues to be conveyed in the same direction until a position A is reached, whereupon it is conveyed in a direction which is perpendicular to the first direction, to a position B which is vertically below the position A while the document 4 is folded upon itself along a centerline thereof. The document is then conveyed and inverted while pressing the fold to a position C which is located vertically below the position B. At the position C, a given number of documents which are conveyed in this manner are temporarily maintained and then stapled by a stapler. The stapled documents are conveyed to a position D which is located rearwardly of the position C, and then conveyed in the opposite direction to the direction in which the documents are initially conveyed while turning the stapled documents through 90° in its original plane. Finally, the turned documents are conveyed at right angles to a position E which is located in front of the conveyor means 3 where a tray 5 (FIG. 1) is provided.

Figure 3:
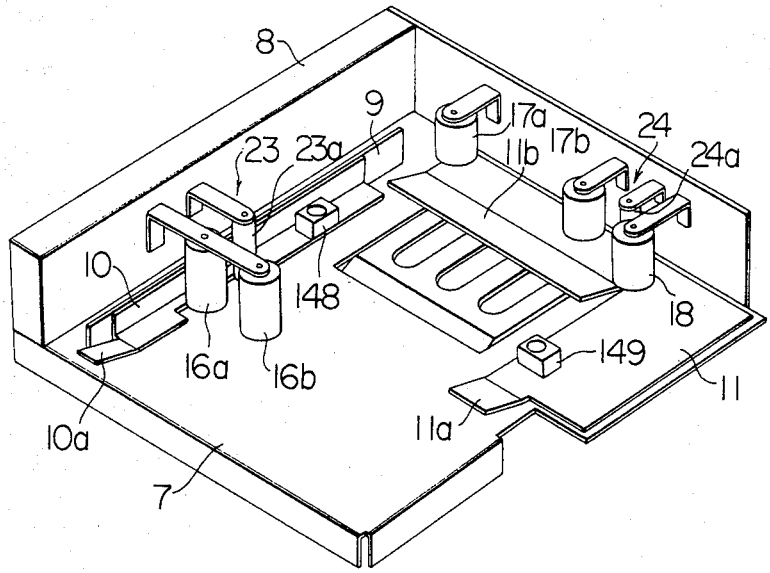
FIG. 3 is a perspective view showing the uppermost portion of the embodiment, with a top cover being removed.
Figure 4:
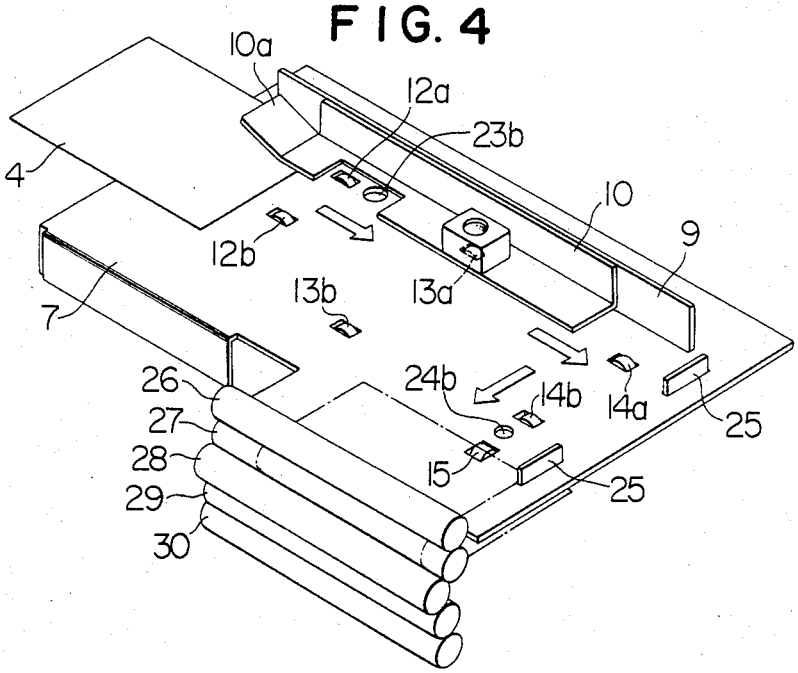
FIG. 4 is a perspective view of the uppermost portion shown in FIG. 3, with a majority of parts located thereon being removed.
Figure 5:
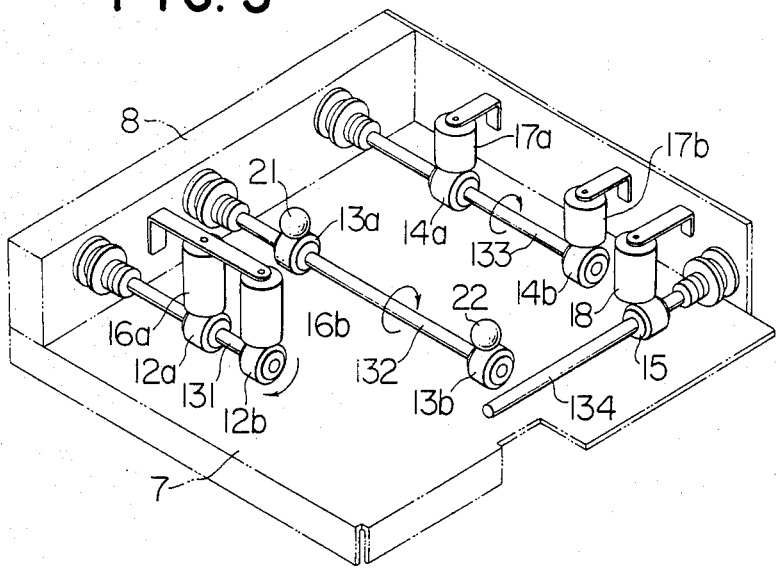
FIG. 5 is a perspective view of the uppermost portion, with a baseplate and a guide plate being removed.
Figure 6:
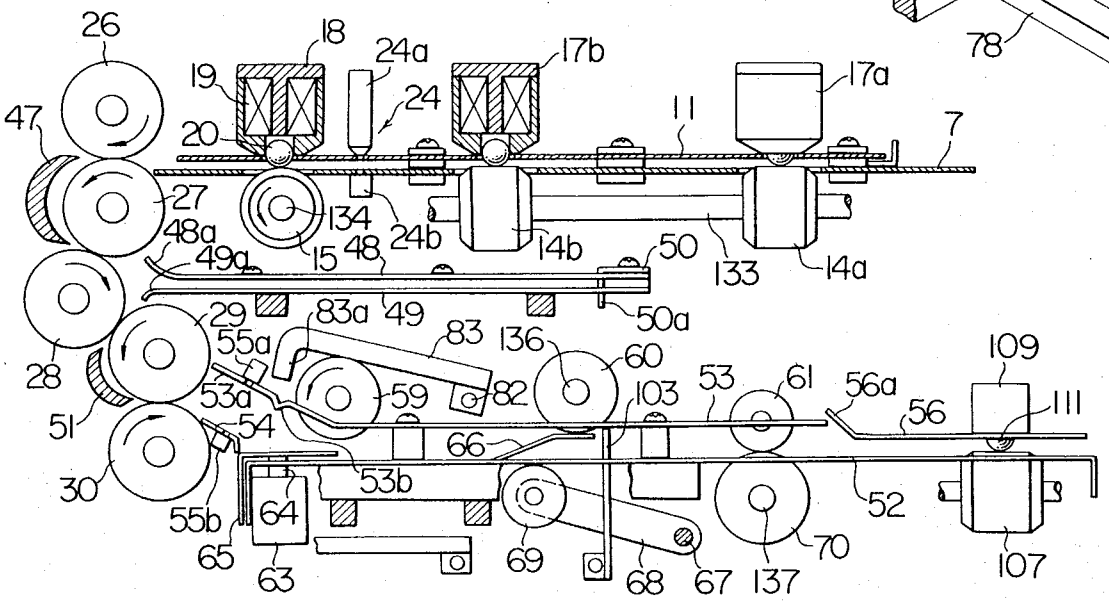
FIG. 6 is a longitudinal section of the embodiment including the uppermost portion taken along a fore-and-aft direction of the apparatus.

Various mechanisms which are used to effect such movement of the documents will now be described. Referring to FIGS. 3 and 4, the appearance of the uppermost portion of the document conveying apparatus 3 is shown with its top cover 6 (FIG. 1) being removed. In FIG. 5, the uppermost portion is shown when a baseplate 7 and plate are removed. FIG. 6 shows a schematic longitudinal section of part of the apparatus including the uppermost portion. In FIGS. 3 to 6, there is shown a baseplate 7 along the rear edge (or the left-hand edge as viewed in FIG. 3) of which is fixedly mounted a protective cover 8 associated with a transmission mechanism. A document guide plate 9 extends in parallel relationship with the cover, and an angled guide plate 10 is fixedly mounted on the plate 9 and includes a horizontal limb 10*a* the forward end of which is slightly raised toward the document delivery end of the copying machine. A suitable clearance is provided between the horizontal limb 10*a* and the baseplate 7. A further guide plate 11 which is generally L-shaped in plan view is secured along the right-hand edge of the baseplate 7, as seen in FIG. 1, with a suitable spacing therebetween, the guide plate 11 having the forward end of its both limbs 11*a*, 11*b* slightly raised toward the document delivery end of the copying machine.

As shown in FIG. 5, disposed below the baseplate 7 are a pair of conveyor rollers 12*a*, 12*b* adjacent the sheet inlet end, which are integrally mounted on a horizontal shaft 131 which extends in a direction parallel to the document supply inlet. Rearwardly spaced from the conveyor rollers 12*a*, 12*b* are another pair of conveyor rollers 13*a*, 13*b* which are integrally mounted on another horizontal shaft 132 which extends parallel to the first mentioned shaft 131. It is to be noted that the spacing provided between rollers 13*a*, 13*b* is larger than that between rollers 12*a* and 12*b* to permit a smooth conveying operation of a document having the maximum width which can supplied to the document conveying apparatus. Toward the right-hand end, as viewed in FIG. 5, the baseplate 7 has a pair of end face aligning rollers 14*a*, 14*b* mounted thereon. These rollers are integrally mounted on a horizontal shaft 133 which also extends parallel to the shaft 132. A transfer roller 15 is integrally mounted on a horizontal shaft 134 extending in a direction perpendicular to the shaft 133 in the forward region of the baseplate towards its right-hand end, as viewed in FIG. 5, for transferring a document to a document folding device. As shown in FIG. 4, each of these rollers appears through an associated rectangular opening formed in the baseplate 7, but it should be noted that the uppermost level of each roller is flush with or slightly below the upper surface of the baseplate 7, as indicated in FIG. 6. It is also to be noted that both of the edges of the respective rollers are chamfered. A plurality of electromagnetic ball control devices 16*a*, 16*b*, 17*a*, 17*b* and 18 are located above the individual rollers 12*a*, 12*b*, 14*a*, 14*b* and 15, and are supported on suitable arms extending from a stationary portion such as the protective cover 8. As typically exemplified by 18 shown in FIG. 6, each of these electromagnetic ball control devices includes an electromagnet 19 and a steel ball 20 which is disposed below the associated electromagnet so as to be vertically movable. When the electromagnet 19 is not energized, the steel ball 20 falls by gravity to urge a sheet which is located between the roller and the steel ball 20 to bear against the roller, thus causing it to be conveyed. However, when the electromagnet 19 is energized, it attracts the steel ball 20 upwardly, thus removing the conveying effect. It is to be noted that steel balls 21, 22 (FIG. 5) are received in flutes formed in blocks 148, 149 which are secured to the guide plates 10, 11 and are normally maintained in abutment against the rollers 13*a*, 13*b*. A pair of sensors 23, 24 which detect the presence of a document have their light emitting elements 23*a*, 24*a* disposed to the right of the control device 16*a* and between the control devices 17*b* and 18, respectively. These sensors also include light receiving elements 23*b*, 24*b* which are mounted under the baseplate in alignment with these light emitting elements. The document sensor 23 responds to the detection of the presence of a document by immediately deenergizing the electromagnetic ball control devices 16*a*, 16*b*, thus allowing a conveying operation of the document. By contrast, the sensor 24 responds in response to the detection of the presence of a document to energize the electromagnetic ball control devices 17*a*, 17*b* and to deenergize the electromagnetic ball control device 18 after a given time delay. In the event of occurrence of a jamming as evidenced by the failure of the sensor 24 to operate after a given time interval has passed since the sensor 23 has operated to detect the document or the sensor 24 remains activated, all the electromagnetic ball control devices are energized to release the conveying effect. It will be noted that a pair of end face aligning tabs 25 are provided on the upper surface of the baseplate 7 along its right-hand end, as seen clearly in FIG. 4.

Figure 7:
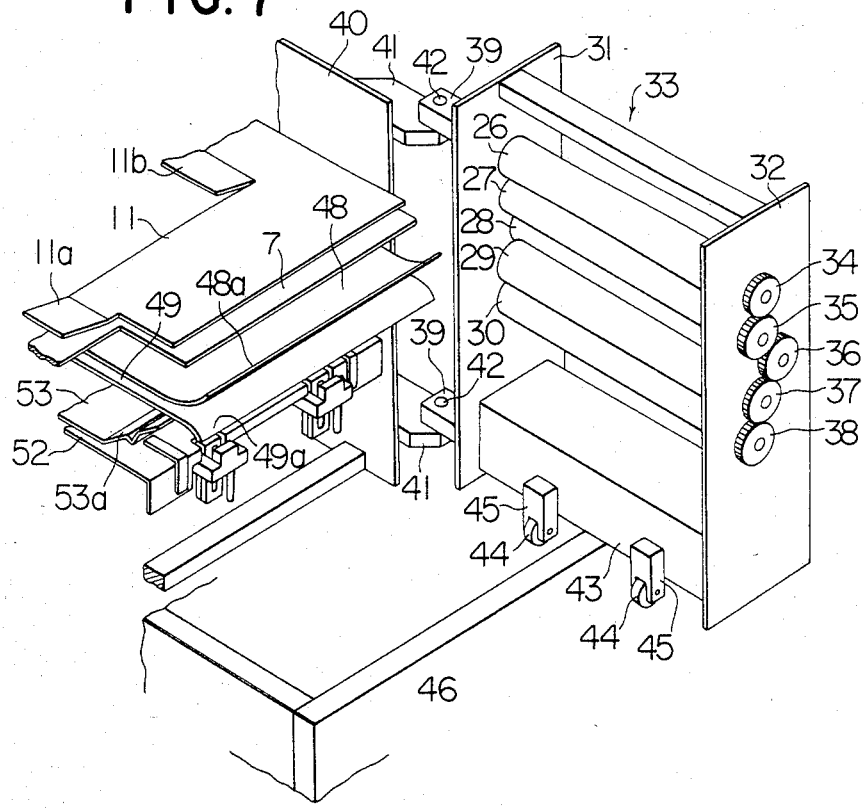
FIG. 7 is a perspective view of a front portion of the embodiment.

A train of abutting rollers 26, 27, 28, 29 and 30 are rotatably mounted in parallel relationship with the front end of the baseplate at a small clearance therefrom along the right-hand one-half thereof. As indicated in FIG. 7, the train of rollers are rotatably mounted on a pair of parallel side plates 31, 32 of a frame 33, and the one end of these rollers which extend beyond the side plate 32 has a respective gear 34, 35, 36, 37 or 38 fixedly mounted thereon. Adjacent gears mesh with each other, and a suitable prime mover gear meshes with one of these gears to drive the rollers in a manner so that adjacent rollers rotate in opposite directions as indicated by arrows in FIG. 6. The upper and lower end of the side plate 31 is formed with outwardly extending bearing blocks 39, which are connected to vertically extending shafts 42 of bearing blocks 41 which are provided on and project from the side wall 40 of the conveying apparatus. In this manner, the frame 33 carrying the train of rollers is rotatable in a horizontal plane about the axis of the connecting shafts 42. However, because it is difficult to support the entire load of the frame 33 by the shafts 42 alone, a block 43 which defines the bottom side of the frame 33 is provided with a pair of bearing blocks 45 which rotatably carry wheels 44, the wheels being rotatable in a vertical plane. These wheels are placed on a horizontal step 46 of the conveying apparatus, thus enabling the load of the frame 33 to be carried by the wheels 44. The purpose of using the rotatable frame 33 to support the train of rollers is to facilitate the maintenance and inspection of the document conveying assembly and the document folding and stapling devices. Normally the frame 33 is closed to extend parallel to the front end of the baseplate 7, and is locked in this place by suitable means. In the closed position of the frame 33, a joining line between the rollers 26, 27 is located opposite to the clearance between the baseplate 7 and the guide plate 11. Consequently, referring to FIG. 6, a document, as it is being conveyed to the left between the baseplate 7 and the guide plate 11, is fed into the nip between the rollers 26, 27, and is fed further to the left as these rollers rotate. Located to the left of the roller 27 as viewed in FIG. 6 is a guide member 47 which is figured in conformity to the cylindrical surface of the roller 27 and disposed at a suitable clearance therefrom. The sheet, as it is conveyed between the rollers 26, 27, is inverted along the guide member 47 before it is fed into the nip between the rollers 27, 28.

As shown in FIGS. 6 and 7, disposed below the baseplate 7 are a pair of vertically spaced guide plates 48, 49. The front end 48*a* or the the left-hand end, as viewed in FIG. 6, of the guide plate 48 is curved in a direction toward the line of junction between the rollers 27, 28 while the front end 49*a* of the guide plate 49 is curved in a direction toward the line of junction between the rollers 28, 29. A stop 50 is fixedly mounted on the rear end of the guide plate 48, and has a folded portion 50*a* which extends through the guide plates 48, 49. The distance from the point of abutment between the rollers 28, 29 to the folded portion 50*a* of the stop 50 is chosen to be one-half the length of the longer side of the document. Consequently, as the document is conveyed between the roller 27, 28, it is guided by the curved ends 48*a*, 49*a* of the guide plates 48, 49 and fed into the space between the latter guide plates. When one-half the length of the document is fed into this space, the end of the document bears against the stop 50 to block a further movement thereof. However, the rollers 27, 28 continue to feed the remaining one-half the length of the document in a forced manner, so that the document will be flexed into an arcuate form in the space defined by the rollers 27, 28, 29, and such flexed portion will be fed into the nip between the rollers 28, 29 to fold the document along a folding line which is located at the lengthwise center of the document. Subsequently, the document is fed to the left as viewed in FIG. 6. In this manner, the rollers 27, 28 and 29 define a document folding roller assembly. It is to be understood that the principle of operation of these rollers to fold a document is quite the same as in a conventional document folding device.

In FIG. 6, a guide member 51 which is configured in conformity to the cylindrical surface of the roller 29 is disposed at a suitable spacing from the latter, and the document which is conveyed by the rollers 28, 29 is inverted when passing along the guide member 51 before it is fed into the nip between the rollers 29, 30. The pair of rollers 29, 30 thus define a press roller assembly which strongly presses the fold of the document, with the fold being fed first, between the rollers 29, 30 before the document is fed further to the right as viewed in FIG. 6.

Figure 8:
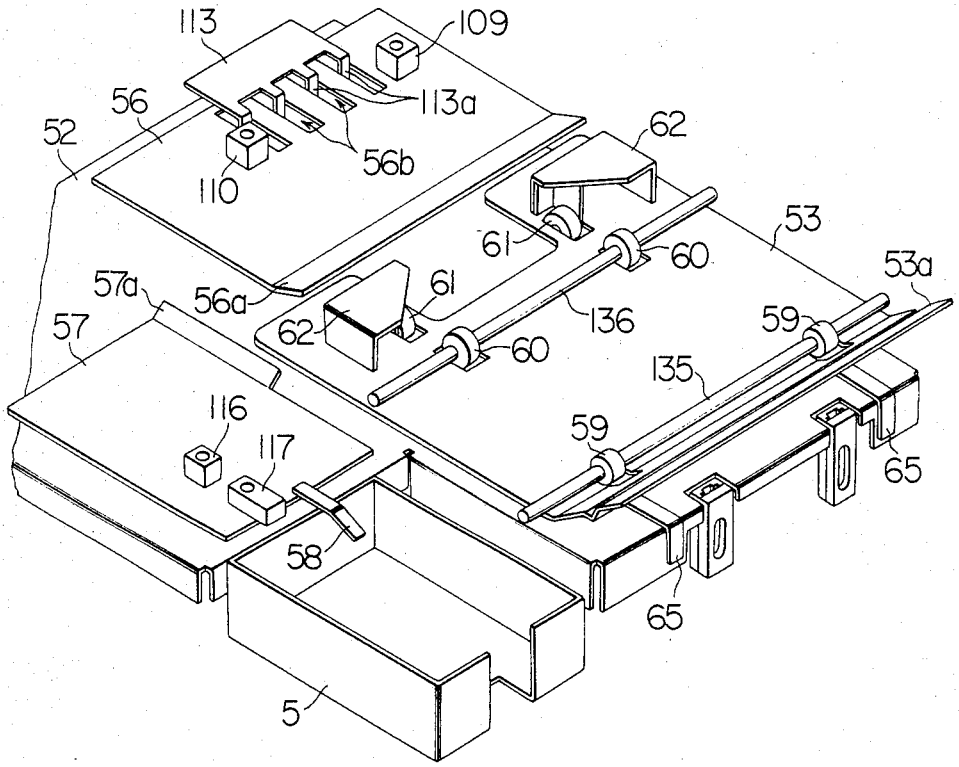
FIG. 8 is a perspective view of a bottom portion of the embodiment including a document stapling device.

Referring to FIGS. 6 to 8, it will be noted that another baseplate 52 is disposed below the guide plates 48, 49, and a guide plate 53 located above the baseplate 52 with a suitable spacing therebetween. The front end 53*a* of the guide plate 53 extends obliquely in the upward direction so as to be directed substantially toward the center of rotation of the roller 29 while a guide plate 54 is connected to the baseplate 52 and extends obliquely in the upward direction so as to be directed toward the line of junction between the rollers 29, 30. The front end 53*a* of the guide plate 53 and the guide plate 54 fixedly carry a light emitting element 55*a* and a light receiving element 55*b*, respectively, of a sensor which are disposed in opposing relationship with each other. The front end portion 53*a* of the guide plate 53 has a downwardly directed tab 53*b* formed in it which extends in the horizontal direction or across the width of the guide plate 53.

As shown in FIGS. 6 and 8, a guide plate 56 is located rearwardly of the guide plate 53 and is disposed above the baseplate 52 with a suitable spacing therebetween. The front end 56*a* of the guide plate 56 is raised obliquely upward toward the front, and the plate 56 is formed with a suitable number of lengthwise elongate slots 56*b* formed in it across its width. The front, left-hand corner of the baseplate 52, as viewed in FIG. 8, is notched to form a rectangular space in which the tray 5 is disposed. Thus, the baseplate 52 is L-shaped in plan view. A guide plate 57 is disposed above the baseplate 52 with a suitable distance therebetween, at the location rearwardly of the tray 5. Along one-half the right-hand edge 57*a*, the guide plate 57 is folded to extend obliquely upward while a document retaining tab 58 projects centrally from the front end of the guide plate 57 toward the tray 5.

Disposed over the guide plate 53 are a pair of rollers 59 which are fixedly mounted on a horizontal shaft 135 rotatably disposed and extending at right angles to the document conveying direction, at the location adjacent the folded portion 53*a*. Part of the rollers 59 extend through openings formed in the guide plate 53 to a position below it. Another pair of rollers 60 are integrally mounted on another horizontal shaft 136 which is rotatably disposed and extends parallel to the shaft 135, at the locations rearwardly spaced from the rollers 59. These rollers 60 also partly project beyond the guide plate 53 by passing through openings formed in the guide plate 53. Finally, a further pair of rollers 61 are rotatably mounted on independent supports 62, and are rotatable in planes which are parallel to the plane in which the rollers 60 rotate. The lower one-half of the rollers 61 project below the guide plate 53 by passing through openings formed therein.

As shown in FIG. 6, an electromagnet 63 is fixedly mounted on the lower surface of the baseplate 52 at the front end thereof, and includes a plunger 64 which extends through the baseplate 52, the free end of the plunger fixedly carrying a leaf spring 65 which is bent at right angles so as to conform to the configuration of the front end of the baseplate 52. When the sensor comprising the light emitting element 55*a* and the light receiving element 55*b* detects the presence of a document, the electromagnet 63 is energized to project the plunger 64 upwardly, thereby urging the rear end of the leaf spring 65 into abutment against the roller 59. It is to be understood that a pair of electromagnets 63 and the leaf springs 65 are provided so as to cooperate with the pair of rollers 59. A leaf spring 66 extends from below the baseplate 52 obliquely upward, and has its free end disposed in abutment against the roller 60. A lever 68 is disposed below the baseplate 52 so as to be rockable about a pin 67, and its free end rotatably carries a roller 69. When the lever 68 rotates clockwise, as viewed in FIG. 6, the roller 69 is brought into abutment against the roller 60. It is to be understood that a pair of levers 68 and rollers 69 are provided for cooperation with the pair of rollers 60. Rollers 70 which are integrally mounted on a shaft 137, extending below the baseplate 52, are maintained in abutment against the rollers 61 within the space between the baseplate 52 and the guide plate 53.

Figure 12:
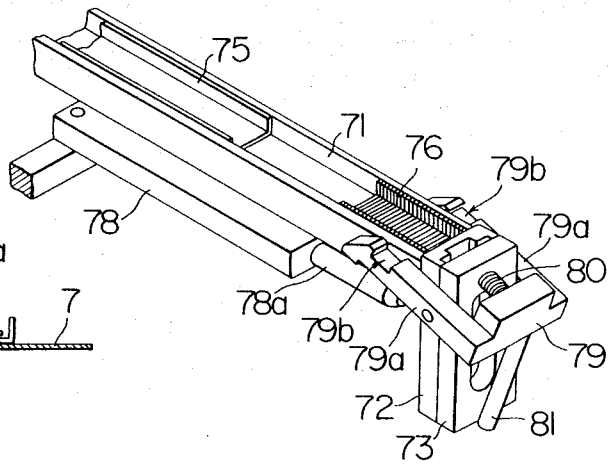
FIG. 12 is a perspective view of the stapling device illustrating a different operative position thereof.
Figure 11:
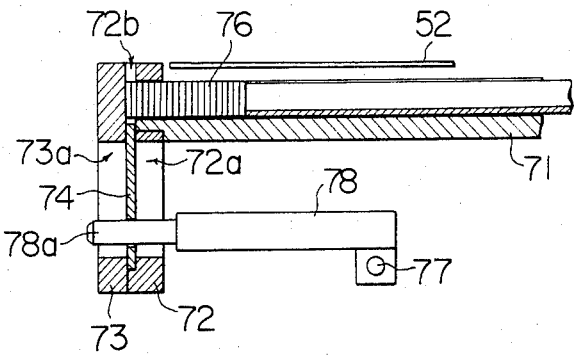
FIG. 11 is a longitudinal section of part of the stapling device.
Figure 10:
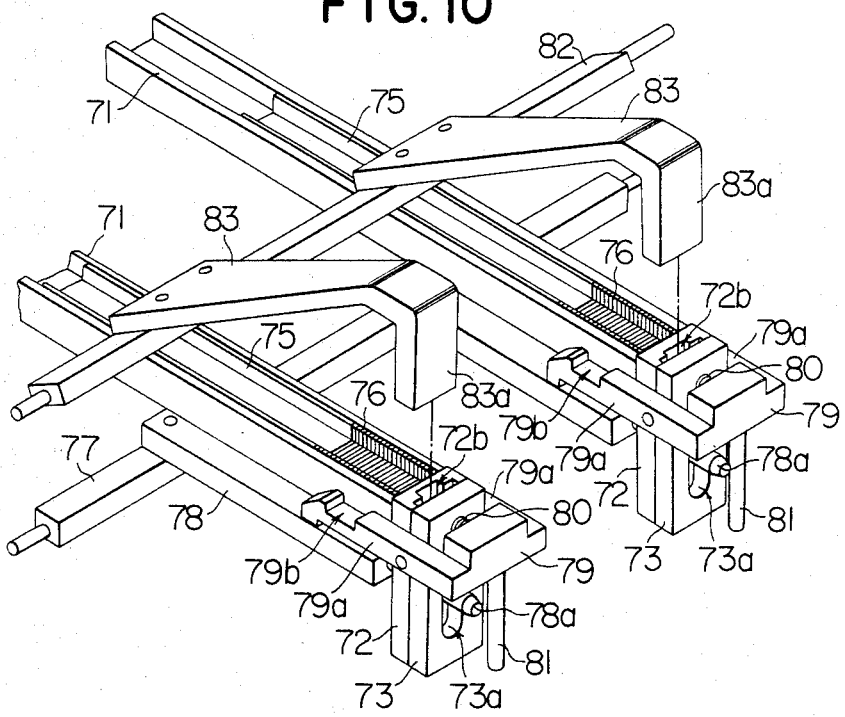
FIG. 10 is a perspective view of the stapling device taken alone.

A pair of staple ejectors as illustrated in FIGS. 10 to 12 are located between the pair of leaf springs 65 which are disposed on the front end of the baseplate 52. Specifically, a channel-shaped staple receiver 71 is disposed below the baseplate 52 and is carried by suitable means so as to be axially slidable. A guide block 72 is fixedly mounted on the front end of the staple receiver 71, and is associated with an abutment member 73 which is fixedly connected therewith in overlapping relationship. The block 72 and the abutment member 73 are formed with vertically elongate slots 72*a*, 73*a* of a same configuration and size which extend therethrough in the fore-and-aft direction thereof. Formed in the front surface of the block 72 is a recessed groove 72*b* which is open at the upper end thereof. A sliding plate 74 is received within the groove 72*b*, which communicates with the channel of the staple receiver 71. Also slidably received within the channel of the staple receiver 71 is a staple abutment 75 which is also channel-shaped and which is resiliently urged by a suitable spring to maintain an array of staples 76, which are disposed within the receiver 71, against the rear surface of the abutment member 73. A rotatable shank 77 has integral arms 78 each having a cylindrical front end portion 78*a* which loosely extend through the sliding plate 74 and the elongate slots 72*a*, 73*a* formed in the block 72 and the abutment member 73, respectively. As the arms 78 rotate about the axis of the shank 77, as viewed in FIG. 11, the sliding plates 74 move upwardly within the recessed groove 72*b*, whereby staples in the array 76 received in the receivers 71 are upwardly ejected out of the grooves 72*b*. Pivotally mounted on both of the lateral sides of the abutment member 73 are the opposite side arms 79*a* of an operating block 79, which is therefore angularly movable in the vertical plane. However, a repulsion spring 80 is interposed between the front surface of the abutment member 73 and the rear surface of the block 79, whereby the block 79 is normally urged to rotate clockwise, as viewed in FIG. 12. Toward their free end, the side arms 79*a* are formed with hook 79*b* in the upper surface, and when members 71, 72, 73 which are formed in an integral manner are depressed to a given position, the hooks 79*b* are engaged by a hook, not shown, which is fixed in a suitable manner, thereby maintaining the block 79 and its side arms 79*a* substantially in their horizontal position. A handle 81 integrally depends downwardly from the lower surface of the block 79, and when it is engaged by a finger and pulled toward the viewer under the condition shown in FIG. 10, the block 79 rotates against the resilience of the spring 80 to disengage the hooks 79*b* from the fixed hook, allowing the integral members 71, 72 and 73 to move toward the viewer, thus disengaging the cylindrical front end portion 78*a* of the arm 78 from the sliding plate 74. Thereupon, the handle 81 may be released to achieve the condition shown in FIG. 12, thus allowing additional staples to be supplied to the receiver 71.

As shown in FIGS. 6 and 10, a pair of stapler arms 83 have their one end fixedly mounted on a rotatable shank 82 at a location above the staple ejectors. The front end of these arms 83 are folded to depend downwardly as indicated at 83*a* and are located directly above the sliding plates 74 when the arms 83 have been turned to their downward limit position.

Figure 13:
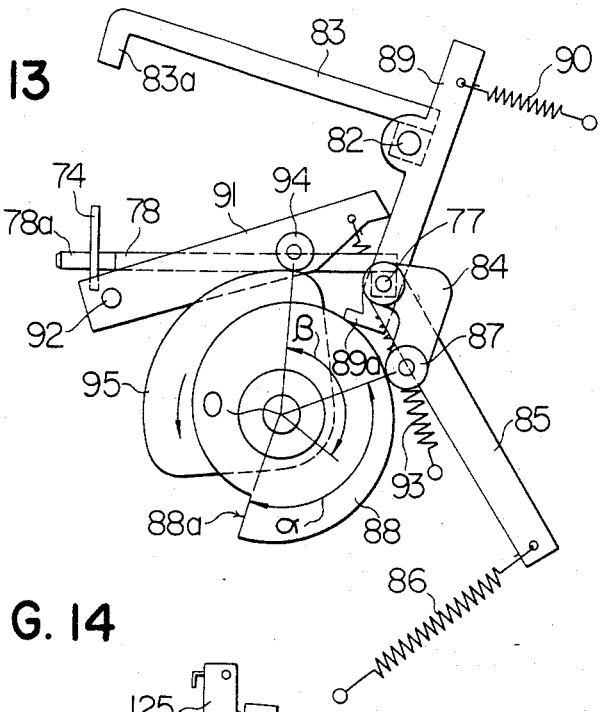
FIG. 13 is a side elevation of a control mechanism associated with the stapling device.
Figure 14:
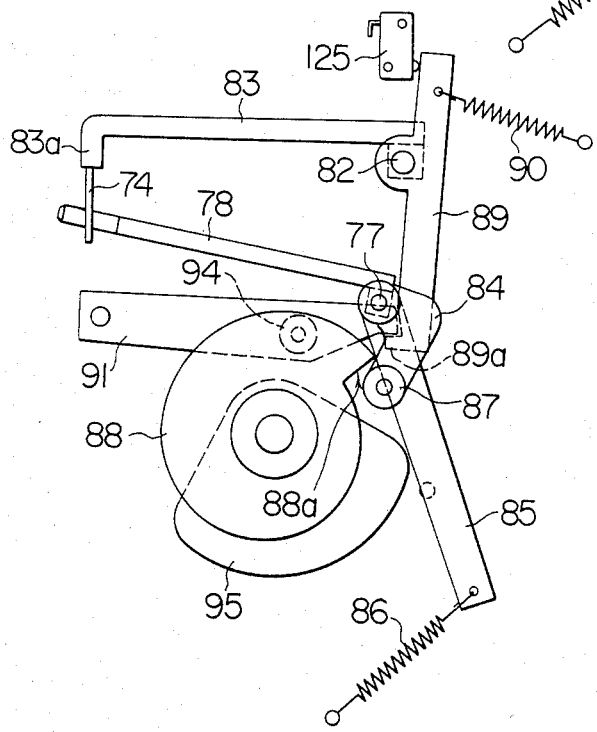
FIG. 14 is a side elevation illustrating a different operative position of the control mechanism.
Figure 15:
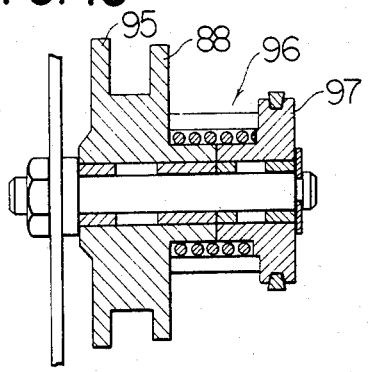
FIG. 15 is a longitudinal section of a cam drive used in the control mechanism.

FIGS. 13 to 15 show a control mechanism for the arms 78 and arms 83. In FIGS. 13 to 15, an L-shaped follower lever 84 has its one end fixedly connected with the shank 77 on which one end of another lever 85 is also fixedly mounted. A spring 86 extends across the other end of the lever 85 and a stationary part to urge the integral members 78, 77, 84 and 85 to rotate clockwise as viewed in FIG. 13. However, the resulting rotation is limited by the abutment of a roller 87 pivotally mounted on the other end of the follower lever 84 against the edge of a cam 88 which has a progressively increasing diameter. The arms 83 are fixedly mounted on a lever 89 by means of the shank 82, and a spring 90 extends across one end of the lever 89 and a stationary part to urge the integral members 82, 83 and 89 to rotate clockwise, as viewed in FIG. 13. However, the resulting rotation is limited by the abutment of the free end of a follower lever 91 against the lateral side of the lever 89 on the opposite side of the shank 82 form said one end. The follower lever 91 is pivotally mounted on a pin 92, and is urged to rotate clockwise, as viewed in FIG. 13, by the resilience of a spring 93 which extends across the free end of the lever and a stationary part. However, under the condition shown in FIG. 13, the resulting rotation is blocked by the abutment of a roller 94 rotatably mounted on the follower lever 91 against a large diameter cam edge of a triangular cam 95. It is to be noted that both of the cams 88 and 95 are integrally formed and are concentric with each other, and are connected to a prime mover pulley 97 through a one-revolution clutch 96. The cam 88 has a radially extending step 88*a* which joins its smallest and its largest diameter. These cams are disposed so that under the normal condition as illustrated in FIG. 13, the angle $\alpha$ defined by a first radius coinciding with the step 88*a* and a second radius extending from the center of rotation 0 to the point of abutment of the roller 87 against the cam 88 is equal to the angle $\beta$ formed by a third radius joining the center 0 with the point of abutment of the roller 94 against the cam 95 and a fourth radius joining the center 0 with a point of the cam 95 which has the minimum radius. Consequently, as the cams 88, 95 rotate counterclockwise, as viewed in FIG. 13, the roller 94 will be contacted by a decreasing diameter of the cam 95 in a sequential manner, so that the follower lever 91 is allowed to rotate clockwise, whereby the free end of the lever 91 causes the lever 89 to rotate counterclockwise against the resilience of the spring 90 while bearing against one lateral side thereof. Ultimately, the free end of the follower lever 91 will engage a hook 89*a* formed in the lower end of the lever 89 before the roller 94 is opposed by a minimum radius of the cam 95, thereby maintaining the arms 83 in their substantial horizontal position as indicated in FIG. 14. When the cams 88, 95 have rotated through the angle $\alpha(=\beta)$, the resilience of the spring 86 causes the roller 87 to move down the step 88*a* toward its minimum radius, whereby the integral members 77, 78, 84 and 85 rapidly swing clockwise to thereby raise the sliding plates 74 toward the end face of the downwardly folded end of the arms 83 to eject ones of staples 76 to staple a plurality of documents disposed in a stack between the folded end 83*a* and the sliding plate 74 with these staples. After one revolution, the cams 88, 95 cease to rotate as result of the operation of the one-revolution clutch 96, whereupon the various members return to their positions shown in FIG. 13.

Figure 16:
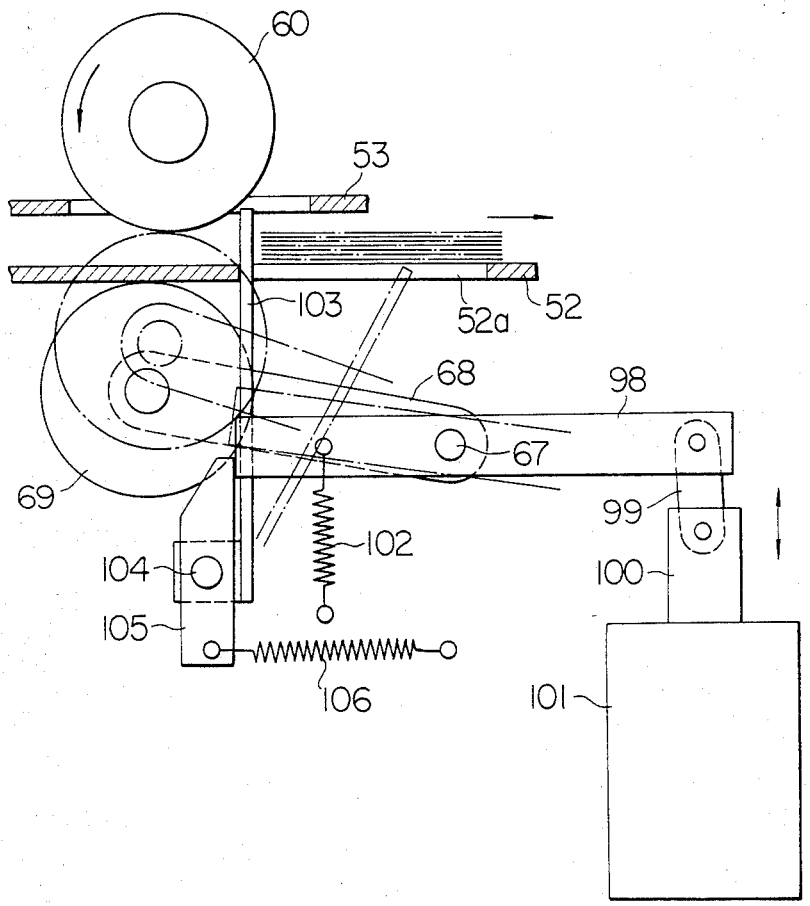
FIG. 16 is a longitudinal section of a document control mechanism which is disposed in the bottom portion.

FIG. 16 shows a control mechanism associated with the lever 68. In FIG. 16, the lever 68 is rotatable on the pin 67 fixedly mounted on a lever 98 which is connected to the plunger 100 of an electromagnet 101 through a link 99. The lever 98 is urged to rotate counterclockwise, as viewed in FIG. 16 by the resilience of a spring 102. Consequently, in the normal position shown in solid line, the lever 68 which is integral with the lever 98 rotates counterclockwise so that the roller 69 is spaced from the roller 60. However, when the electromagnet 101 is energized to attract the plunger 100 which then moves downwardly, the levers 68, 98 rotate in the opposite direction against the resilience of the spring, bringing the roller 69 into abutment against the roller 60 as shown in phantom line. It is to be noted that disposed below and rearwardly of the roller 60 is the free end of a control lever 103 which extends through the baseplate 52 from below and which is pivotally mounted on a pin 104. The pin 104 couples the lever 103 with another lever 105. A spring 106 extends across one arm of the lever 105 and a stationary part to urge the levers 105, 103 to rotate counterclockwise. However, the resulting rotation is blocked by the abutment of the lever 103 against the edge of an opening 52*a* formed in the baseplate 52 and through which it extends, the levers 103, 105 assuming then a vertical position. A rotation of the levers 105, 103 in the opposite direction is also blocked by the abutment of one end of the lever 98 against the lateral side of the lever 105 at its upper end. The electromagnet 101 can be energized by a manual operation or in response to a command signal.

Figure 9:
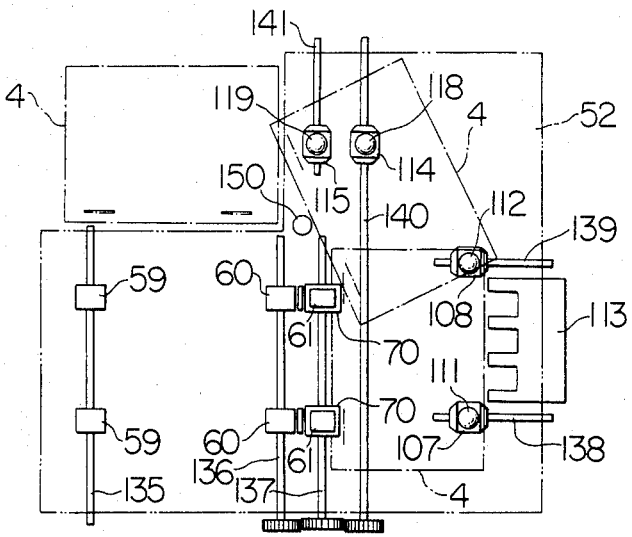
FIG. 9 is a plan view of the bottom portion, with a baseplate and a guide plate being removed.
Figure 17:
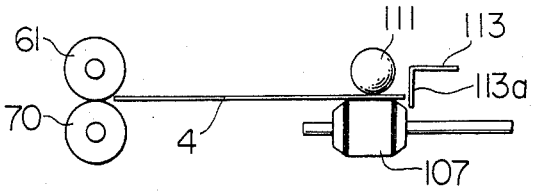
FIG. 17 is a side elevation illustrating the dimensional relationship between the rollers disposed in the bottom portion and the document.

Toward the rear edge of the baseplate 52, a pair of rollers 107, 108 are located below the baseplate and are fixedly mounted on a separate rotating shafts 138, 139 so as to be rotatable in a plane which is perpendicular to the plane in which the rollers 61 rotate, as shown in FIGS. 6 and 9. Part of these rollers 107, 108 project through an opening in the baseplate 52 above it. As shown in FIGS. 8 and 9, a pair of blocks 109, 110 are fixedly mounted on the guide plate 56 at locations directly above the rollers 107, 108, and are formed with flutes receiving steel balls 111, 112 which bear against the rollers 107, 108 by gravity. A stop 113 has a comb-shaped front end portion, the free ends 113*a* of which loosely fit in the plurality of slots 56*b* formed in the guide plate 56. These free ends 113*a* also loosely extend through slots formed in the baseplate 52 in the same manner as the slots 56*b*. The stop 113 assumes a position which is adjustable along the length of these slots so as to be moved in accordance with the size of a document being conveyed. As shown in FIG. 17, the distance between the point of junction between the rollers 61, 70 and the point of junction between the roller 107 and the steel ball 111 is chosen to be slightly less than the size of the document 4 being conveyed as viewed in the direction in which it is conveyed. The distance between the point of junction between the rollers 61, 70 and the end face of the free ends 113*a* of the stop 113 is chosen to be slightly greater than the size of the document 4 as viewed in the direction in which it is conveyed.

As shown in FIG. 9, located rearwardly of the notch in which the tray 5 is disposed are a pair of rollers 114, 115 which are spaced apart one after another and which are fixedly mounted on separate rotating shafts 140, 141 below the baseplate 52. These rollers are rotatable in a plane which is perpendicular to the plane in which the rollers 107, 108 rotate. Part of the rollers 114, 115 extend through openings formed in the baseplate 52, above it. As shown in FIGS. 8 and 9, a pair of blocks 116, 117 are fixedly mounted on the guide plate 57 at locations directly above the rollers 114, 115, and are formed with flutes receiving steel balls 118, 119 which bear against these rollers by gravity. The spacing between a line extending from a point of contact between the roller 108 and the steel ball 112 in the axial direction of the roller 108 and a line extending from a point of contact between the roller 114 and the steel ball in a direction at right angles to the axis of the roller 14 is chosen to be sufficiently less than the length of the document being conveyed by the rollers 107, 108. The roller 114 is located so that the document being conveyed by the rollers 107, 108 rides up this roller. It is to be noted that both edges of the rollers 107, 108, 114 and 115 are chamfered.

In operation, when the document 4 is delivered from the delivery end of the copying machine 1 (FIG. 1), it is fed into the space between the baseplate 7 and the guide plate 10 as shown in FIGS. 3 to 6, and thence into the clearance between the feed rollers 12*a*, 12*b* and the electromagnetic ball control devices 16*a*, 16*b*. The steel balls associated with the control devices 16*a*, 16*b* are normally in their upper position as a result of the energization of the electromagnet of these devices, but as the document reaches the sensor 23, these electromagnets cease to be energized, whereby the steel balls of the devices falls down by gravity to urge the document 4 against the rollers 12*a*, 12*b*. Since these rollers 12*a*, 12*b* are driven for clockwise rotation, as viewed in FIG. 5, the cooperation between the rollers 12*a*, 12*b* and the electromagnetic ball control devices 16*a*, 16*b* permit the document 4 to be conveyed from left to right, as viewed in FIG. 5, the document being fed slightly upward as it is conveyed to the right. The rollers 13*a*, 13*b* are also driven for rotation in the same direction and are normally engaged by the steel balls 21, 22 by gravity, so that the cooperation of these rollers and the steel balls permit the sheet to be conveyed in the same direction. The rollers 14*a*, 14*b* are also driven for rotation in the same direction. The rollers 14*a*, 14*b* are also driven for rotation in the same direction and are engaged by the steel balls of the electromagnetic ball control devices 17*a*, 17*b*, so that the document 4 further continues to be conveyed in the same direction. However, when the presence of the document is detected by the sensor 24 and a sufficient time has passed for the leading end of the document to reach the location of the end aligning tabs 25, the electromagnets of the electromagnetic ball control devices 16*a*, 16*b*, 17*a* and 17*b* are energized to attract their associated steel balls upward, and hence away from the rollers 12*a*, 12*b*, 14*a*, 14*b*, whereby the document conveying effect afforded by these rollers is terminated. It is to be understood that the position of the of the document at this time is free from any skewing effect since the cooperation of the rollers 14*a*, 14*b* and the steel balls of the electromagnetic ball control devices 17*a*, 17*b* urge the end faces of the document against the end aligning tabs 25. It is to be noted that the deskewing action took place very smoothly as compared with that achieved by a pair of abutting rollers because the document conveying means comprises rollers and steel balls which are maintained in point contact and since the steel balls can be rotatable in any direction. After a sufficient time has passed to allow the deskewing action to be completed, the conveying action by the rollers 14*a*, 14*b* is terminated, thereby preventing a buckling of the document while simultaneously preventing a jamming or presence of any uncorrected skew.

Figure 19:
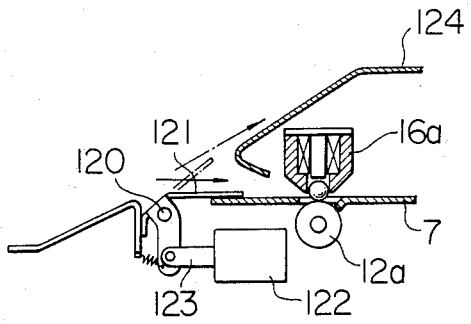
FIG. 19 is a longitudinal section of one form of receptor which receives a document from the exterior.

The electromagnet of the electromagnetic ball control device 18 ceases to be energized concurrently with or slightly delayed with respect to the interruption of the document conveying effect by the rollers 14*a*, 14*b*, whereby the steel ball associated with this control device fall down by gravity to bear against the delivery roller 15. Since the document 4 is already present over the roller 15 when the deskewing action take place, the steel ball urges the document against the roller 15 to deliver it in a direction at right angles to the feed direction as the roller 15 rotates counterclockwise, as viewed in FIG. 6. When a sufficient time has passed to effect the document delivery in response to the detection of the presence of the document by the sensor 24, the control devices 16*a*, 16*b*, 17*a* and 17*b* are deenergized while the electromagnetic ball control device 18 is energized to return to their respective original conditions. A failure of the document sensor 24 to operate within a given time interval after the detection of a document by the sensor 23 which is located at the inlet end or a failure of the sensor 24 which actually operated, but remains in its operative position and does not return to its original position even after a given time interval has passed represents the occurrence of a jamming. Hence, in this instance, all the electromagnetic ball control devices are energized to attract their associated steel balls to release the conveying effect by the individual rollers. It is desirable that a document blocking device as indicated in FIG. 19 be provided in order to prevent a document as delivered from the copying machine from being supplied into the conveying apparatus 3 in the event a jamming occurred. Specifically, referring to FIG. 19, a guide plate 121 is rotatably mounted on a horizontal pin 120 at a location forwardly spaced from the document feed inlet of the baseplate 7, and is normally urged by suitable spring to open the document inlet. The guide plate 121 includes an integral arm, to the free end of which the plunger 123 of an electromagnet 122 is pivotally connected. In the event a jamming is detected from the timing of operation of the sensors 23, 24, the electromagnet 122 is energized to attract the plunger 123, whereby the guide plate 121 is forcedly rotated against the resilience of the spring to close the document inlet, as shown in phantom line in FIG. 19. In this instance, a document delivered from the copying machine is conveyed into a receiving tray located on a cover 124 by being moved over the guide plate 121 and the cover.

As the document is conveyed by the cooperation of the roller 15 and the electromagnetic ball control device, it is fed into the nip between the rollers 26, 27, whereupon it is inverted by a guiding action of the guide member 47 as mentioned previously, and then one-half of the document which is located foremost is once fed into the space between the guide plates 48, 49 until the fold 50*a* of the stop 50 interrupts a further movement thereof. In the meantime, the remaining one-half of the document continues to be fed forward by the rollers 27, 28. Because the leading one-half of the document is maintained between the guide plates 48, 49, it cannot be flexed. As a result, the central portion of the document which now occupies a space defined by the rollers 27, 28 and 29 and the front ends of the guide plates 48, 49 flex downwardly into an arcuate form, which is then held between the rollers 28, 29, which then forms a folding line along the center line of a document. It is to be noted that the location of the stop 50 is adjustable in the fore-and-aft direction sc that the folding line is always formed along the center line of the document in accordance with the size thereof.

After the folding line is formed by the rollers 28, 29, the document is further conveyed by these rollers to extend along the guide member 51, which inverts it when it is fed into the nip between the rollers 29, 30. As mentioned previously, these rollers 29, 30 define a press roller assembly which strongly presses the document along the folding line and feeds it between the front end 53*a* of the guide plate 53 and the guide plate 54. The sensor comprising the light emitting element 55*a* and the light receiving element 55*b* detects the presence of the document to energize the electromagnet 63, whereupon the leaf spring 65 is brought into abutment against the roller 59. Since the roller 59 is rotating counterclockwise as viewed in FIGS. 6 and 18, the document which is fed between the roller 59 and the leaf spring 65 continues to be conveyed to the right, as viewed in FIGS. 6 and 18, by the rotating force of the roller 59 until the leading end of the document is urged by the leaf spring 66 against the counterclockwise rotating roller 60, which conveys it to the right as viewed in FIGS. 6 and 18. However, the control lever 103 extends uprightly immediately behind the roller 60 and is prevented from angular movement in either direction by the edge of the opening 52*a* formed in the baseplate 52 and by the lever 98, as shown in solid line in FIG. 16, so that a further conveying operation of the document is interrupted by the lever 103.

Successive copies are fed from the copying machine 1 and pass along the described path to be sequentially folded by the press roller assembly 29, 30. The electromagnet 63 is energized each time the sensor detected the presence of the document, whereby the leaf spring 65 is driven upward into abutment against the roller 59, as shown in phantom line in FIG. 18, to convey the respective documents to the right, thus placing them one above another in a stack in the sequence of the number of pages.

Figure 18:
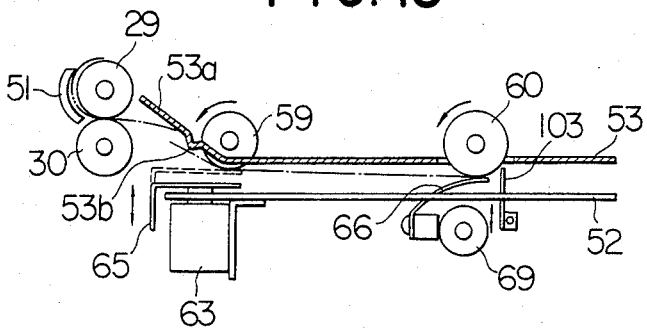
FIG. 18 is a longitudinal section of part of the bottom portion.

The length of the stack of documents placed between the baseplate 52 and the guide plate 53, as viewed in the fore-and-aft direction or in the left-hand direction of FIG. 18, is sufficient to extend across the substantial portion of the leaf spring 65 with the right-hand end defined by the control lever 103, so that as the documents are sequentially fed, the stack of documents move upwardly as the leaf spring 65 is driven upward to limit the space available for the placement of subsequent documents, resulting in the likelihood that a new document may find its way into interstices between the adjacent documents in the stack. However, the front end 53*a* of the guide plate 53 is formed in it with the downwardly directed tab 53*b* which extends across the width of the guide plate 53, so that if the trailing ends of documents in the stack curl toward the guide plate 53, they cannot be located above the tab 53*b*. In this manner, the tab 53*b* is effective to maintain a given space between the uppermost document in the stack and the front end 53*a* for allowing a new document to be placed on top of the stack in the proper sequence of the page numbers without finding its way into interstices between the adjacent documents of the stack.

When a given number of documents are stacked in this manner, the one-revolution clutch 96 (FIG. 15) is started in response to a command from either the copying machine 1 or the conveying apparatus 3, thereby rotating the cams 88, 95 through one revolution. In the course of rotation of the cams 88, 95 through one revolution, the arms 78 which rotates as a result of the bias supplied by the spring 86 cause the sliding plates 74 to be driven upward against the end face of the bent end 83*a* of the arms 83 which now assume substantially their horizontal position, whereupon the sliding plates 74 eject staples 76(FIG. 10) to staple the stack of documents along their trailing edge, as mentioned previously in connection with FIG. 14. At this time, the document stapling operation can be exercised reliably since a rotation of the arms 83 is prevented to occur in response to an upward drive transmitted from the sliding plates 74 inasmuch as the lever 89 which is integral with the arm 83 are maintained in engagement with the lever 91.

The arms 78, 83 and the sliding plates 74 constitute together a pair of staplers. In other words, the stack of documents are filed at two spaced locations. When the cams 88, 95 come to a stop after rotating through one revolution to complete the stapling operation, the staplers are returned to their original positions and remain quiescent until the next stapling operation takes place.

When the stapling operation is completed, the electromagnet 101 (FIG. 16) is energized in synchronized relationship therewith, for example, by an actuation of a switch 125 by the lever 89 as illustrated in FIG. 14, whereupon the plunger 100 is attracted to the electromagnet 101 to rotate the levers 68, 98 against the bias applied thereto. Thus, the lever 98 disengages the lever 105 while the roller 69 moves into abutment against the roller 60, whereby the stack of documents which are disposed on the roller 69 and which are filed along their trailing edge have their leading edge brought into abutment against the roller 60. The pressure with which the document are urged against the roller 60 by the action of the roller 69 is greater in magnitude than the pressure supplied by the leaf spring 66, so that there occurs a strong conveying effect which is enhanced by the interaction between the rollers. Consequently, the filed stack of documents forces the control lever 103 to be turned against the bias while being conveyed to the right, as viewed in FIG. 16. Conveying means comprising the rollers 61, 70 is disposed on the path of such conveyance and allows the documents to be further conveyed in the same direction. After the documents have passed, the levers 68, 98, 103 and 105 are returned to their original position by the resilience applied thereto.

When the leading end of the documents of the stack which is conveyed by the rollers 61, 70 reaches the point of contact between the rollers 107, 108 and the steel balls 111, 112, the documents push the steel balls 111, 112 upwardly to find their way into the space between the raised steel balls and the rollers 107, 108. The rotation of the rollers 107, 108 applies a conveying effect in a direction perpendicular to the previous direction, but during the time the trailing end of the documents are located between the rollers 61, 70, they cannot be moved in the new direction. Immediately before the abutment of the leading end of the documents 4 against the fold 113*a* of the stack 113, they move away from the rollers 61, 70 as shown in FIG. 17, whereby the cooperation of the rollers 107, 108 and the steel balls 111, 112 is effective to convey the documents 4 in the perpendicular direction or in the upward direction, as viewed in FIG. 9.

When the leading end of the documents 4 which are being conveyed by the rotating rollers 107, 108 reaches the location of the conveying means which comprises the roller 114 and the steel ball 118, the leading end of the documents pushes the steel ball 118 upwardly to find their way into the space between the ball and the roller 114. The rotation of the roller 114 produces a conveying effect in a direction perpendicular to the direction of conveyance by the roller 108. At this time, the trailing end of the documents 4 is subject to only a point contact with the roller 108 and the steel ball 112 which is rotatable in any direction, so that the interaction between the conveying means 108, 112 and the conveying means 114, 118 gradually diverts the position of the documents 4 toward the tray 5 (FIG. 8). This action is assisted by a diverting guide pin 150 which controls the position of the documents and by the conveying effect by the combination of the roller 115 and the steel ball 119, eventually turning the documents through 90°. After the position of the documents 4 is changed in this manner, the conveying means 114, 118 and the conveying means 115, 119 conveys the documents 4 in a direction parallel to their longer side or the fore- and-aft direction of the conveying apparatus 3 (in the left- and-right direction as viewed in FIG. 9) until they are delivered onto the tray 5. The position of the documents are turned through 90° and the documents are delivered in a direction parallel to their longer side because the space available for the installation of the tray 5 is limited in such direction. If a sufficient space is available, there is no need for the turning.

What is claimed is:

1. A document handling device for producing bound stacks of documents received from a machine such as a printing machine, a copying machine or the like; comprising a first conveying means for conveying documents received from said machine to a handling section; said handling section including a folding device for folding each received document along a line, a stacking device located at a level beneath that of said folding device and including a stop member, means for sequentially feeding the folded documents with their fold lines as their leading edges from said folding device and directing them into engagement with said stop member to stack said documents in said stacking device, means for binding the trailing edge portions of the documents stacked in said stacking device, and second conveying means for feeding the bound stack of documents to a delivery area.

2. A document handling device as in claim 1, said handling section including a train of rollers comprising a press roller pair for forming the fold line of each document and feeding it to said stacking device.

3. A document handling device as in claim 1, said handling section including a train of rollers including a first roller pair conveying each document into a holding device having means for causing a mid region of the document to flex outwardly, and a press roller pair for receiving the flexed midregion of the document and creasing it to form said fold line.

4. A document handling device as in claim 1, said stacking device including a document receiving station having an inlet and an outlet, a guide plate disposed above said inlet and extending upwardly towards said folding device, and means including a tab extending downwardly from said guide plate for depressing the trailing edge portion of the uppermost document in the stack thereof.

5. A document handling device as in claim 4, said stacking device further including a feed roller extending through said guide plate, an abutment member located adjacent said feed roller, and means for moving said abutment member away from said feed roller to allow stacking of said documents and later toward said feed roller to convey said stacked documents from said stacking device.

6. A document handling device as in claim 1, said binding means including a stapling device having means for holding a plurality of staples, a staple ejector for ejecting staples from said staple holding means, a drive arm for moving said staple ejector to eject a staple into one side of the stack of documents, a staple abutment member arranged for movement on the opposite side of said documents, and means for moving said abutment member toward said stack of documents synchronously with movement of said drive arm to secure said staples to the stack of documents.

7. A document handling device as in claim 6, said means for moving said staple abutment member synchronously with said drive arm including a rotatable shaft, a first cam operable to move said drive arm, said first cam being mounted centrally to said shaft and having a circular cam surface increasing in distance from said shaft, and a second cam operable to move said staple abutment member, said second cam being mounted centrally to said shaft and having a generally triangular cam surface.

8. A document handling device as in claim 7, said shaft being connected to a source of rotational power through a clutch enabling a single revolution of said shaft for actuating said binding means.

9. A document handling device as in claim 1, said first conveying means being adapted to convey a document in a first direction from said machine and then convey the document in a second direction toward said handling section, said first conveying means including a plurality of rollers adapted to engage the underside of said document for conveying it in the required direction, a steel ball located above each respective roller for urging the document into engagement with said rollers, and a plurality of electromagnetic control devices each adapted to raise a respective steel ball to reduce the engagement of the document with the roller therebelow.

10. A document handling device as in claim 9, said first conveying means including alignment means for aligning each said document before conveying it in said second direction.

11. A document handling device as in claim 10, said first conveying means including a plurality of said rollers arranged along the first direction of travel and at least one tab extending across the end of the path of said first direction of travel, said aligning means including control means activating the electromagnetic control devices for all the rollers arranged along said first direction except those rollers adjacent said at least one tab.

12. A document handling device as in claim 1, said second conveying means being adapted to convey a document in a first direction from said stacking device and then a second direction toward said delivery area, said second conveying means including a plurality of rollers adapted to engage the underside of said document for conveying it in the required direction, a steel ball located above each respective roller for urging the document into engagement with said rollers, and a plurality of electromagnetic control devices each adapted to raise a respective steel ball to reduce the engagement of the documents with the roller therebelow.

13. A document handling device as in claim 12, said second conveying means further including means to rotate said bound documents through an angle of approximately 90° prior to discharge to said delivery area.

* * * * *